US007462038B2

(12) United States Patent
Knoefler et al.

(10) Patent No.: US 7,462,038 B2
(45) Date of Patent: Dec. 9, 2008

(54) INTERCONNECTION STRUCTURE AND METHOD OF MANUFACTURING THE SAME

(75) Inventors: Roman Knoefler, Gerstdorf (DE); Christoph Kleint, Dresden (DE); Steffen Meyer, Dresden (DE); Nicolas Nagel, Dresden (DE)

(73) Assignee: Qimonda AG, Munich (DE)

( * ) Notice: Subject to any disclaimer, the term of this patent is extended or adjusted under 35 U.S.C. 154(b) by 0 days.

(21) Appl. No.: 11/676,622

(22) Filed: Feb. 20, 2007

(65) Prior Publication Data

US 2008/0200046 A1 Aug. 21, 2008

(51) Int. Cl.
*H01R 12/00* (2006.01)

(52) U.S. Cl. ..... 439/66

(58) Field of Classification Search ..... 439/66, 439/69, 71; 257/700
See application file for complete search history.

(56) References Cited

U.S. PATENT DOCUMENTS

| | | | | |
|---|---|---|---|---|
| 5,532,614 | A * | 7/1996 | Chiu | 324/763 |
| 5,828,226 | A * | 10/1998 | Higgins et al. | 324/762 |
| 6,384,475 | B1 * | 5/2002 | Beroz et al. | 257/690 |
| 6,400,010 | B1 * | 6/2002 | Murata | 257/706 |
| 6,445,001 | B2 * | 9/2002 | Yoshida | 257/48 |
| 6,672,875 | B1 * | 1/2004 | Mathieu et al. | 439/66 |
| 6,676,438 | B2 * | 1/2004 | Zhou et al. | 439/482 |
| 6,756,244 | B2 * | 6/2004 | Liebeskind | 438/14 |
| 6,774,486 | B2 * | 8/2004 | Kinsman | 257/734 |
| 6,797,616 | B2 * | 9/2004 | Kinsman | 438/667 |
| 6,907,658 | B2 * | 6/2005 | Li | 29/832 |
| 7,083,425 | B2 * | 8/2006 | Chong et al. | 439/66 |
| 7,097,462 | B2 * | 8/2006 | Ichikawa | 439/66 |
| 7,287,322 | B2 * | 10/2007 | Mathieu et al. | 29/842 |
| 7,301,103 | B2 * | 11/2007 | Tanaka et al. | 174/250 |
| 2001/0012706 | A1 * | 8/2001 | Imaeda | 439/66 |
| 2001/0016436 | A1 * | 8/2001 | Wimmer | 439/66 |
| 2002/0013070 | A1 * | 1/2002 | Fork et al. | 439/66 |
| 2002/0108778 | A1 * | 8/2002 | Dishongh et al. | 174/261 |
| 2002/0151194 | A1 * | 10/2002 | Grube | 439/66 |
| 2002/0155737 | A1 * | 10/2002 | Roy et al. | 439/66 |
| 2003/0047809 | A1 * | 3/2003 | Takeuchi et al. | 257/758 |
| 2004/0029411 | A1 * | 2/2004 | Rathburn | 439/66 |
| 2006/0180905 | A1 * | 8/2006 | Zeng et al. | 257/678 |
| 2007/0161266 | A1 * | 7/2007 | Nishizawa | 439/69 |
| 2007/0184677 | A1 * | 8/2007 | Sukegawa et al. | 439/66 |
| 2007/0245553 | A1 * | 10/2007 | Chong et al. | 29/843 |

FOREIGN PATENT DOCUMENTS

| | | | |
|---|---|---|---|
| DE | 19983428 | B4 | 4/2003 |
| EP | 0741410 | A2 | 11/1996 |
| WO | 9718587 | A1 | 5/1997 |

* cited by examiner

*Primary Examiner*—Ross N Gushi
(74) *Attorney, Agent, or Firm*—Edell, Shapiro & Finnan, LLC

(57) ABSTRACT

An interconnection structure includes two staggered contact rows of evenly spaced contacts. Each contact row extends along a first direction. The interconnection structure further includes conductive lines extending along a second direction that intersects the first direction. The interconnection structure further includes intermediate contacts, where each intermediate contact is in contact with one of the contacts and one of the conductive lines.

16 Claims, 13 Drawing Sheets

A - A'

A - A'

A-A'

A-A'

A - A'

A - A'

A-A'

A-A'

INTERCONNECTION STRUCTURE AND METHOD OF MANUFACTURING THE SAME

BACKGROUND

Memory cells of memory arrays such as volatile or non-volatile memory arrays use an interconnection structure to connect the memory cells of the array to support circuits (e.g., sense amplifiers, decoders and wordlines). Future technologies aim for smaller minimum feature sizes to increase the storage density and to reduce the cost of memory products. When scaling memory arrays down to smaller minimum feature sizes, interconnection structures also have to be scaled down. Scaling down of interconnection structures such as bitlines and bitline contacts comprising minimum feature sizes is crucial and challenging in view of feasibility of lithography, taper of contact edge or resistance of fill materials, for example.

SUMMARY

An interconnection structure is described herein, which can, for example, be used in a memory cell array such as a volatile or non-volatile memory cell array. A memory device, a memory card comprising the memory device and an electric device configured to be connected to the memory card are also described herein. In addition, a method of manufacturing an interconnection structure is described herein.

An interconnection structure comprises two staggered rows of evenly spaced contact openings, wherein each contact row extends along a first direction. The interconnection structure further comprises conductive lines, which extend along a second direction intersecting the first direction, as well as intermediate contacts, wherein each intermediate contact is in contact with one of the contacts and one of the conductive lines.

The accompanying drawings are included to provide a further understanding of the embodiments of the present invention and are incorporated in and constitute a part of this specification. The drawings illustrate the embodiments of the present invention and together with the description serve to explain the principles of the invention. Other embodiments and many of the intended advantages will be readily appreciated as they become better understood by reference to the following detailed description. The elements of the drawings are not necessarily to scale relative to each other. Like reference numerals designate corresponding similar parts.

DETAILED DESCRIPTION

Figure 1B:
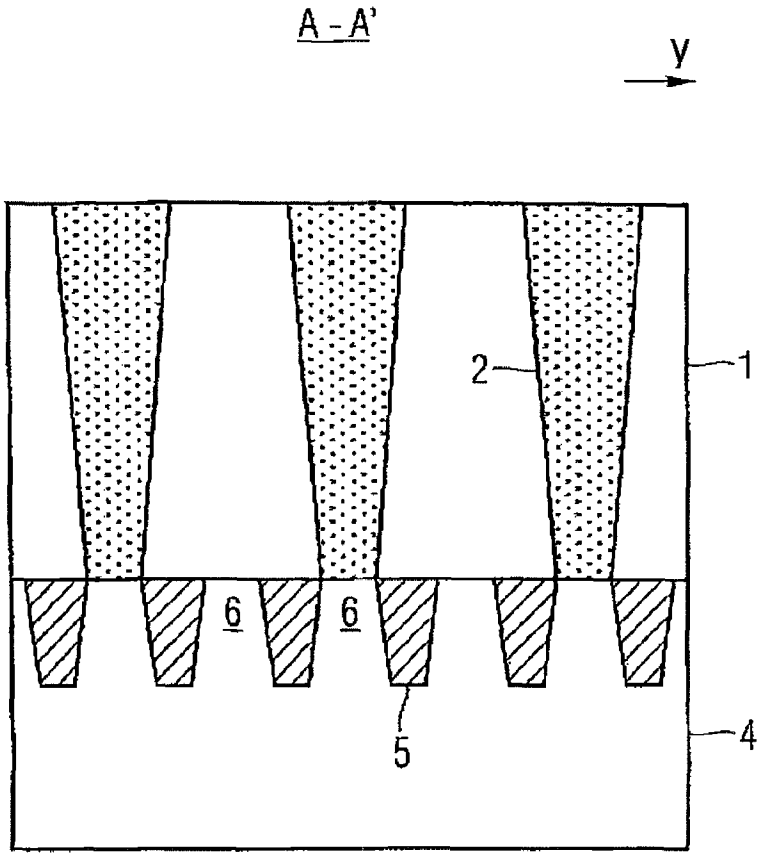
FIGS. 1A to 3B show plan views and cross-sectional views of a section of a substrate during an exemplary embodiment of manufacturing an interconnection structure.

In the following detailed description reference is made to the accompanying drawings, which forms a part hereof and in which are shown by way of illustration specific embodiments. In this regard, directional terminology such as "top", "bottom", "front", "back", "leading", "trailing", etc., is used with reference to the orientation of the Figures being described. Since components of embodiments may be positioned in a number of different orientations, the directional terminology is used for purposes of illustration and in no way limiting. It is to be understood that further embodiments may be utilized and structural or logical changes may be made. The following detailed description, therefore, is not to be taken in a limiting sense.

According to an embodiment an interconnection structure comprises two staggered rows, i.e., first and second rows, of evenly spaced contact openings, wherein each contact row extends in a first direction. The interconnection structure further comprises conductive lines, which extend along a second direction intersecting the first direction, as well as intermediate contacts, wherein each intermediate contact is in contact with one of the contacts and one of the conductive lines. The interconnection structure further comprises an insulating layer, which adjoins a bottom side of the conductive lines and a sidewall of the intermediate contacts.

The conductive lines, intermediate contacts and contacts may form bitlines and bitline contacts connecting memory cells to support circuits. However, the conductive lines, intermediate contacts and contacts may also be used to connect any kind of functional region of an integrated circuit to a further functional region of the integrated circuit. The conductive lines, intermediate contacts and contacts may be formed of any conductive material such as metal, noble metal, metal alloys or doped semiconductors. Although a common material may be used to realize the conductive lines, intermediate contacts and contacts, material compositions of these parts may also entirely or partly differ from each other. Exemplary materials include: W, TiN, WN, TaN, Cu, Ta, Al, metal silicides, doped silicon or any combination thereof. The conductive lines, intermediate contacts and contacts may be surrounded by a liner, for example. The insulating layer being in direct contact with a bottom side of the conductive lines and a sidewall of the intermediate contacts may be formed of any material suitable to electrically isolate conductive regions from each other. Exemplary materials include oxides and nitrides, e.g., silicon oxide and silicon nitride. The second direction may be perpendicular to the first direction, for example.

According to a further embodiment the contacts of the two staggered rows are shifted by one half contact pitch to each other. According to an exemplary embodiment the contacts of one row are equally spaced by four times a minimum feature size, wherein the contacts of the two staggered rows are shifted by twice the minimum feature size to each other.

A further embodiment provides an interconnection structure, wherein a dimension of the intermediate contacts along the first direction is smaller than a largest dimension of the contacts along the first direction. As the contacts are connected to the conductive lines by the intermediate contacts, it is possible to dimension a top side of the contacts along the first direction larger than a bottom side of the conductive lines. Thus, requirements with regard to a critical dimension on top of the contacts can be relaxed.

According to a further embodiment, the intermediate contacts are formed as a trimmed part of the respective contacts shortened along the first direction. As the trimmed part may be fabricated by an etch process, sidewalls of the intermediate contact along the first direction will not be covered by a liner in case the contacts below are surrounded by such a liner.

A further embodiment relates to an interconnection structure wherein the intermediate contacts are intermediate contact lines, which extend along the second direction and are at least part of a line array. The line array offers benefits in view of feasibility of lithography when realizing interconnection structures involving components having minimum feature sizes.

According to a further embodiment of the interconnection structure, each intermediate contact line in contact with a respective contact of one of the two staggered rows is absent in an intersection region with regard to the other one of the two staggered rows. By leaving out the intermediate contact line in the intersection region undesirable shorts to contacts of the other one of the two staggered contact rows, which may be caused by process variations, are prevented.

The line array may further comprise intermediate contact lines and further lines. The further lines may be appropriately positioned to achieve a line array that is beneficial with regard to feasibility of lithography during manufacture of the line array.

A further embodiment relates to an interconnection structure comprising two staggered contact rows of evenly spaced contacts, i.e., first and second contact rows, wherein each contact row extends along a first direction. The interconnection structure further comprises conductive lines, which extend along a second direction intersection the first direction, as well as intermediate contacts, wherein each intermediate contact is a trimmed upper part of a respective contact that adjoins one of the conductive lines.

The interconnection structure may further comprise an insulating layer, which adjoins a bottom side of the conductive lines and a sidewall of the intermediate contact regions. The insulating layer may be a single layer, for example.

According to a further embodiment, an interconnection structure comprises two staggered contact rows of evenly spaced contacts, i.e., first and second contact rows, wherein each contact row extends along a first direction. The interconnection structure further comprises conductive lines, which extend along a second direction intersecting the first direction, as well as intermediate contacts, wherein each intermediate contact is an intermediate contact line extending along the second direction, and wherein each intermediate contact line is in contact with one of the contacts and one of the conductive lines.

The interconnection structure may further comprise an insulating layer, which adjoins a bottom side of the conductive lines and a sidewall of the intermediate contact lines.

A further embodiment relates to an interconnection structure, wherein the intermediate contact lines are at least part of a line array.

According to a further embodiment of the interconnection structure, each intermediate contact line in contact with a respective contact of one of the two staggered rows is absent in an intersection region with regard to the other one of the two staggered rows.

A further embodiment relates to an interconnection structure, wherein a dimension of the intermediate contact lines along the first direction is smaller than the largest dimension of the contacts along the first direction.

According to a further embodiment, a non-volatile semiconductor memory device comprises a memory cell array of non-volatile memory cells and an interconnection structure as defined by any of the above described embodiments, wherein the conductive lines define bitlines and the contacts and respective intermediate contacts define bitline contacts. The non-volatile memory cells may be memory cells of a floating gate NAND array, for example. The interconnection structure may, for example, also be included in: a NROM (Nitrided Read Only Memory), DRAM (Dynamic Random Access Memory), charge trapping NAND memory, SONOS (Silicon-Oxide-Nitride-Oxide-Silicon) memory, SANOS (Silicon-$AI_2O_3$-Nitride-Oxide-Silicon) memory, TANOS (Oxide-SiN-$Al_2O_3$- TaN) memory.

A further embodiment relates to an electric memory card comprising a non-volatile semiconductor memory device as defined above.

A further embodiment relates to an electric device comprising an electric card interface, a card slot connected to the electric card interface and the electric memory card as defined above, wherein the electric memory card is configured to be connected and removed from the card slot. The electric device may be a cellular phone, a personal computer (PC), a personal digital assistant (PDA), a digital still camera, a digital video camera or a portable MP3 player, for example.

A further embodiment relates to a method of forming an interconnection structure comprising providing a substrate, providing a first insulating layer on the substrate, etching, into the first insulating layer, two staggered rows of evenly spaced contact openings, i.e., first and second rows, wherein each row extends along a first direction, filling the contact openings with a conductive material to provide contacts, providing a second insulating layer on the first insulating layer and the contacts, etching intermediate contact openings into the second insulating layer, providing intermediate contacts by filling the intermediate contact openings with a conductive material and providing conductive lines on the second insulating layer and the intermediate contacts, wherein the conductive lines extend along a second direction intersecting the first direction.

The substrate may be a semiconductor substrate such as a silicon substrate, which may be pre-processed to fabricate a semiconductor memory device therein, for example. The above method features may be included in a semiconductor memory process. Thus, above described method features may be simultaneously used for fabrication of further components outside of the interconnection structure.

It should be noted that, generally, for patterning material layers by etching, a photolithographic method may be used in which a suitable photo resist material is provided. The photo resist material is photolithographically patterned using a suitable photo mask. The patterned photo resist layer can be used as a mask during subsequent process steps. For example, as is common, a hardmask layer or a layer made of a suitable material such as silicon nitride, polysilicon or carbon may be provided over the material layer to be patterned. The hardmask layer is photolithographically patterned using an etching process, for example. Taking the patterned hardmask layer as an etching mask, the material layer is patterned. A patterning of the material layer by etching may also be carried out by using the patterned photo resist material as an etching mask.

According to a further embodiment, a dimension of each of the intermediate contact openings along the first direction is smaller than a largest dimension of each of the contacts along the first direction.

A further embodiment comprises a method of forming the interconnection structure, wherein, when filling the intermediate contact openings with the conductive material, the conductive material is additionally applied on the second insulating layer. The conductive material on the second insulating layer is then etched to provide the conductive lines. Thus, the conductive material for the intermediate contacts and the conductive lines is applied by a common process step.

According to a further embodiment, the feature of providing the conductive line comprises providing a conductive layer on the second insulating layer and the intermediate contacts and etching the conductive layer to provide the conductive lines. This embodiment utilizes separate steps for providing the material of the intermediate contacts and the conductive lines.

A further embodiment comprises a method of forming the interconnection structure, wherein the features of providing the intermediate contacts and the conductive lines comprise etching the second insulating layer to provide conductive line trenches and filling the intermediate contact openings and the conductive line trenches to provide the intermediate contacts and the conductive lines. Here, the intermediate contacts and the conductive lines are formed in a dual damascene process.

According to a further embodiment of the method of forming the interconnection structure, the feature of providing the conductive lines comprises providing a third insulating layer on the second layer and the intermediate contacts, etching the third insulating layer to provide conductive line openings and filling the conductive line openings with a conductive material to provide the conductive lines. This embodiment relates to a damascene process with regard to the conductive lines, wherein the process is integrated into the method of forming the interconnection structure.

A further embodiment relates to a method of forming an interconnection structure comprising providing a substrate, providing a first insulating layer on the substrate, etching, into the first insulating layer, two staggered rows of evenly spaced contact openings, wherein each row extends along a first direction, filling the contact openings with a conductive material to provide contacts, providing a mask structure on the first insulating layer and the contacts, wherein the mask structure partly covers the contacts, etching uncovered portions of the contacts, thereby generating voids and trimming a dimension of the contacts along the first direction in upper contact regions defining intermediate contacts, wherein a lower contact region remains unaltered, filling the voids with an insulating material and providing conductive lines on the first insulating layer and the intermediate contacts, wherein the conductive lines extend along a second direction intersecting the first direction.

According to yet another embodiment of the method of forming an interconnection structure, when filling the voids with the second insulating layer, the second insulating layer is also applied on the first insulating layer and the intermediate contacts. The feature of providing conductive lines comprises etching the second insulating layer to provide conductive line openings and filling the conductive line openings with a conductive material to provide the conductive lines. This embodiment relates to a damascene process with regard to the fabrication of the conductive lines.

A further embodiment comprises a method of forming the interconnection structure, wherein the feature of providing the conductive lines comprises providing a conductive layer on the first insulating layer, the second insulating layer and the intermediate contacts as well as etching the conductive layer to provide the conductive lines.

Exemplary embodiments of the device and method are described in connection with the figures.

Figure 1A:
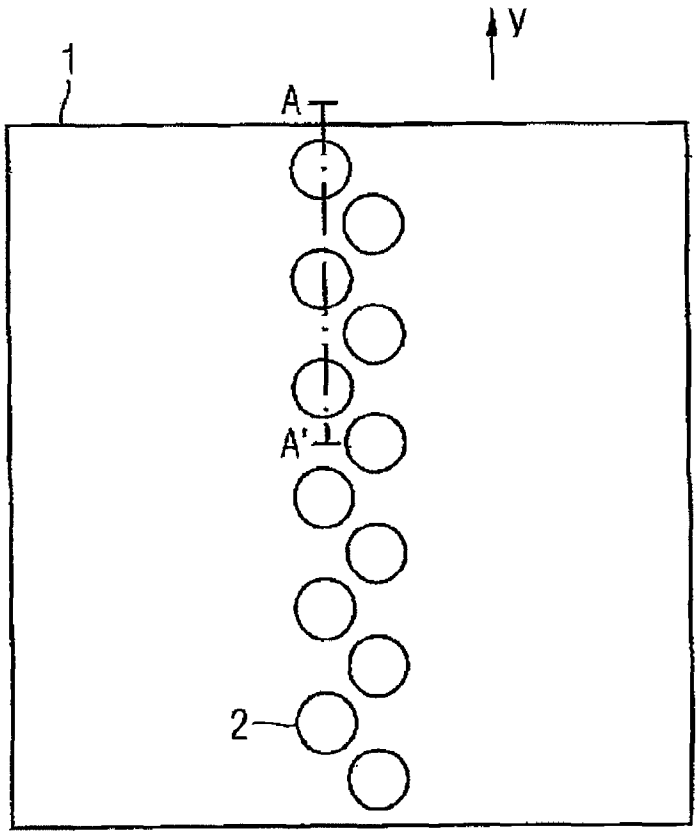

FIGS. 1A to 3B illustrate plan views and cross-sectional views of a section of a substrate during manufacture of an interconnection structure according to an embodiment of the invention. Referring to FIG. 1A, a plan view of a first insulating layer 1 is shown, wherein two staggered contact rows of evenly spaced contacts 2 extending along a first direction y are formed within the first insulating layer 1. The first insulating structure may be formed on a semiconductor substrate.

FIG. 1B illustrates a schematic cross-sectional view of the section of a substrate along an intersection line A-A' of FIG. 1A. A semiconductor substrate 4, such as a silicon substrate is provided. As shown in FIG. 1B, the substrate 4 may comprise STI (shallow trench isolation) regions 5 insulating neighboring active areas 6 from each other. The active areas 6 are formed in surface regions of the substrate 4. Within the active areas 6, memory cell transistors may be formed (not shown), for example. However, as is obvious to the person skilled in the art, any substrate configuration may be used. The substrate 4 may already have a layer stack formed thereon, for example. Differently stated, the substrate may be pre-processed in any way up to a process stage prior to formation of an interconnection structure.

The interconnection structure to be formed may serve as bitlines and bitline contacts of a non-volatile memory device, for example. The first insulating layer 1 is applied on a surface of the substrate 4, followed by etching of contact openings into the insulating layer 1 down to the active areas 6. The contact openings are then filled with a conductive material to provide the contacts 2. By way of example, the contact openings may be filled by tungsten CVD (tungsten chemical vapor deposition) followed by CMP (chemical mechanical polishing) to remove tungsten material applied on the surface of the insulating layer 1. As can be gathered from FIG. 1B, a pitch of the contacts 2 in the first direction y equals twice a pitch of the active areas 6 within the semiconductor substrate 4. Every second active area 6 along the first direction y, which is not yet contacted by a contact 2 of the illustrated contact row, will be contacted by further contacts 2 of the other of the two staggered contact rows (not shown).

Figure 2B:
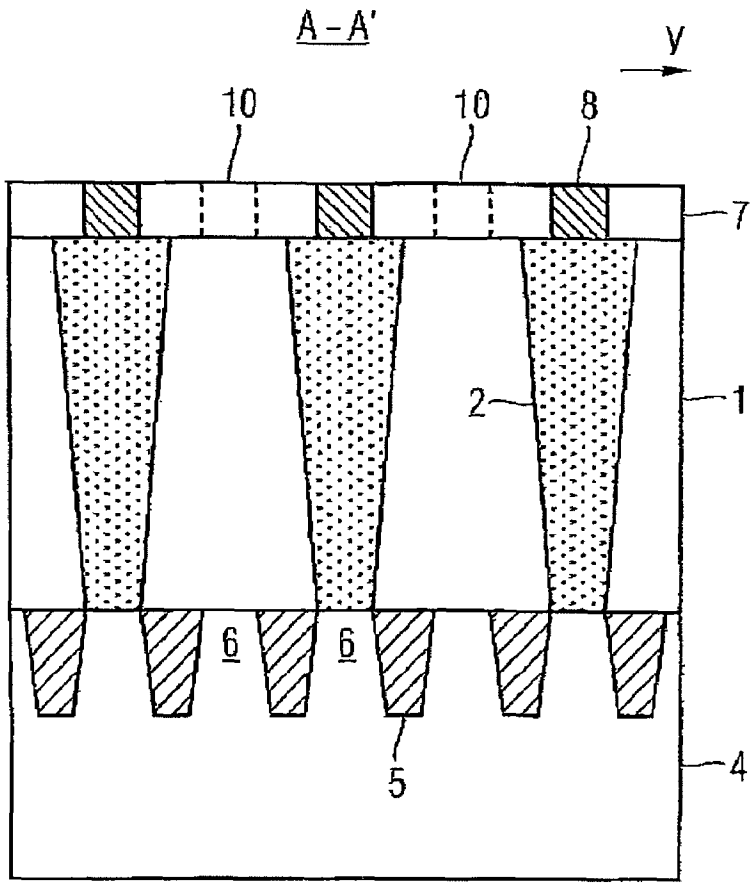
Figure 2A:
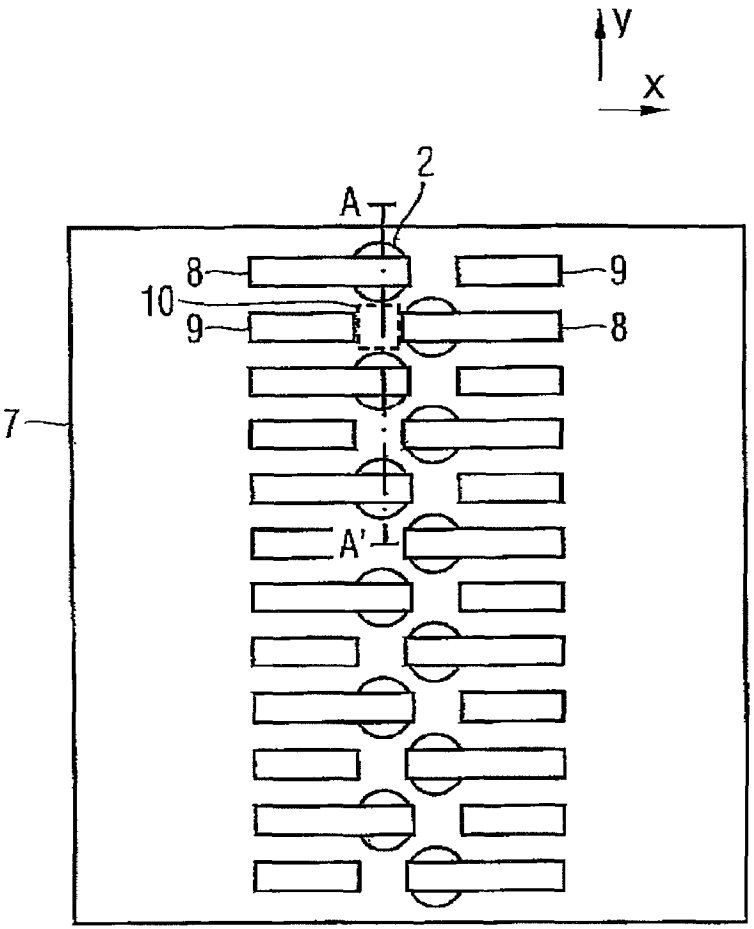

Referring to FIG. 2A, a second insulating layer 7 is applied on the first insulating layer 1, wherein intermediate contact lines 8 extending along a second direction x are provided within the second insulating layer 7. Each of the intermediate contact lines 8 is in contact with one of the contacts 2 of the two staggered contact rows. To increase illustration, the contacts 2, although covered by the second insulating layer 7, are visible in the schematic plan view of FIG. 2A. For further illustration purposes, it is to be noted that also following plan views may indicate covered elements for illustration purposes and to provide a deeper understanding of the respective embodiments. A dimension of the intermediate contact lines 8 along the first direction y is smaller than a top dimension of the contacts 2 along the first direction y. The dimension and also a pitch of the intermediate contact lines 8 along the first direction y may match to conductive lines to be formed in later process steps. The intermediate contact lines 8 together with further lines 9 also extending along the second direction x form a line array beneficial with regard to feasibility of lithography, e.g., overlay control with regard to conductive lines to be formed. Each line in the line array of FIG. 2A comprises one of the intermediate contact lines 8 and one of the further lines 9, wherein each intermediate contact line 8 in contact with a respective contact of one of the two staggered rows is absent in an intersection region 10 with regard to the other one of the two staggered contact rows. In other words, each line of the line array is disrupted in the respective intersection region 10 to prevent shorts between contacts of both staggered contact rows that may be caused by insufficient overlay control during lithography of intermediate contacts and conductive lines having minimum feature sizes.

While the invention has been described in detail with reference to a specific embodiment of an arrangement of two contact rows of evenly spaced contacts, i.e., first and second contact rows, it is to be understood that, to one of ordinary skill in the art, the invention further relates to a plurality of first and second contacts rows without departing from the spirit and scope of the appended claims and their equivalents.

Referring to FIG. 2B, the second insulating layer 7 is applied on the first insulating layer 1, followed by etching openings for intermediate contact lines 8 and further lines 9 (further lines 9 not visible), which are then filled with a conductive material to provide the intermediate contact lines 8 and further lines 9 (further lines 9 not visible).

Figure 3B:
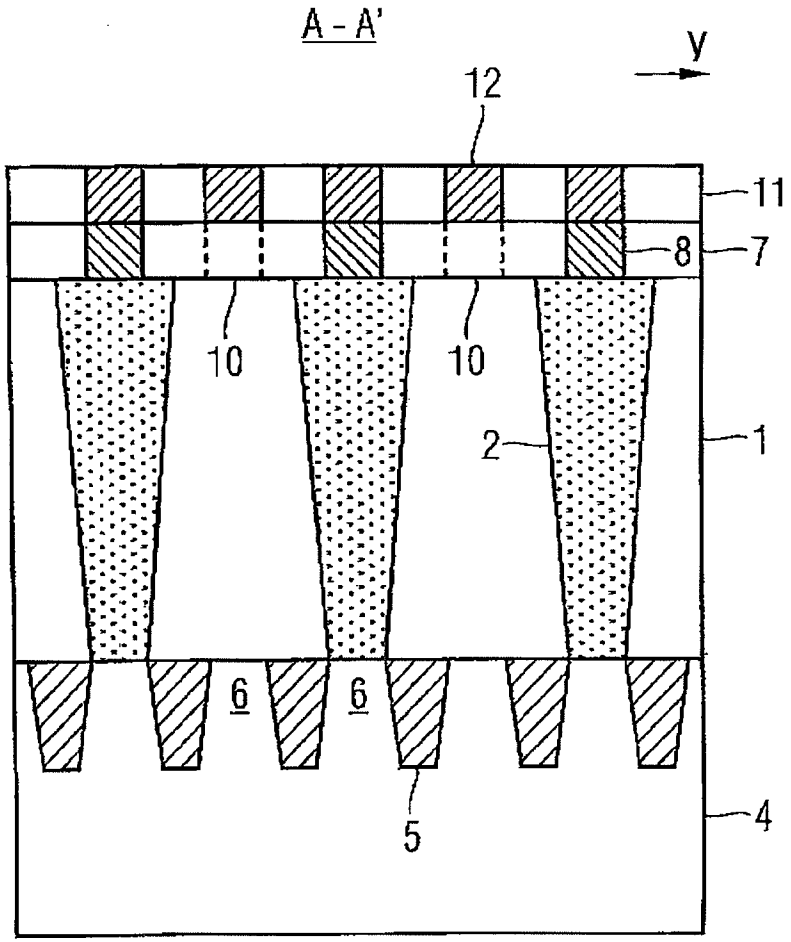
Figure 3A:
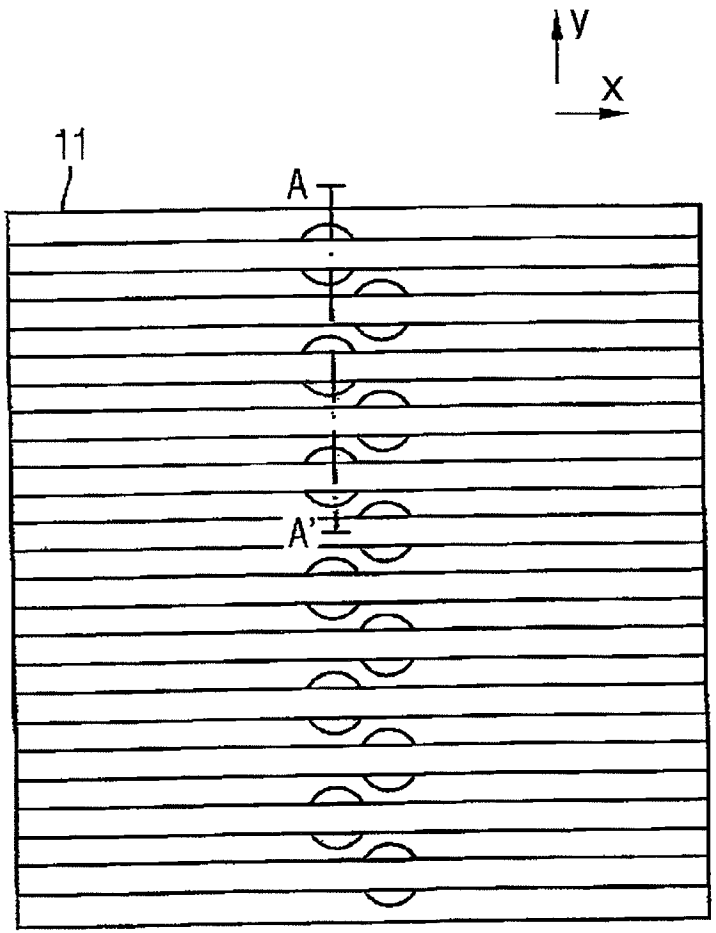

Next, referring to FIG. 3A, a third insulating layer 11 is applied on the second insulating layer 7, the intermediate contact lines 8 and the further lines 9, wherein conductive lines 12 extending along the second direction x are formed within the third insulating layer 11.

A cross-sectional view along the intersection line A-A' of FIG. 3A is shown in FIG. 3B. After forming the third insulating layer 11 on the second insulating layer 7, the intermediate contacts 8 and the further lines 9, conductive line openings are etched into the third insulating layer 11, followed by filling up the openings with a conductive material to provide the conductive lines 12. Each of the intermediate contact lines 8 connects one of the contacts 2 and one of the conductive lines 12. As can be gathered from the cross-sectional view of FIG. 3B, a pitch of the intermediate contact lines 8 along the contact row of intersection line A-A' equals twice the pitch of the conductive lines 12. As two staggered contact rows, i.e., first and second contact rows, are provided, each of the conductive lines 12 is connected to a contact of either one of the two contact rows.

Figure 4B:
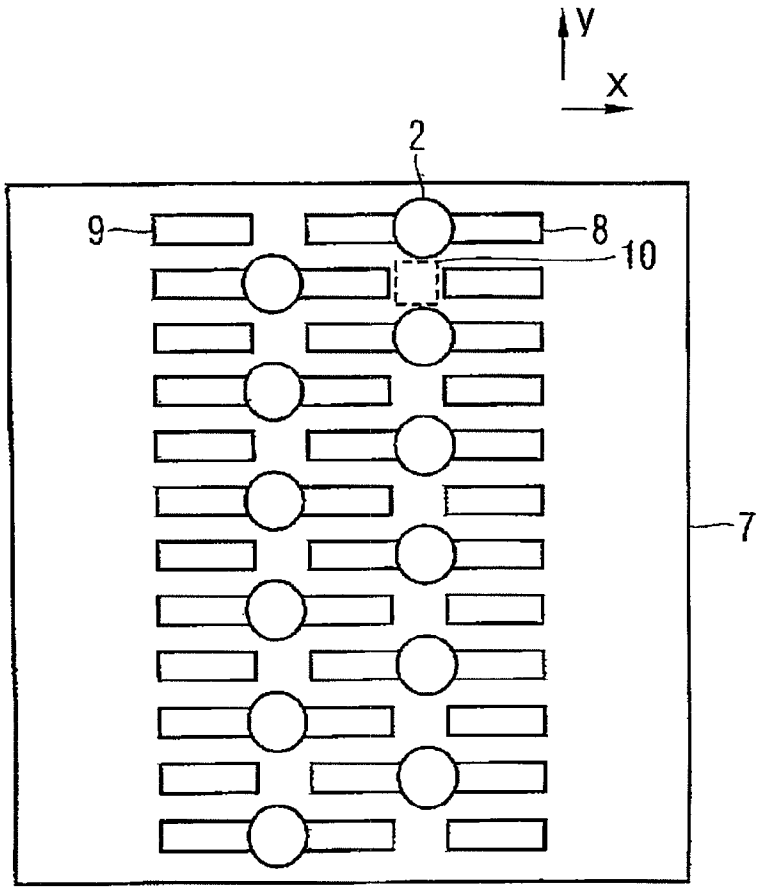
FIGS. 4A and 4B show plan views of the section of a substrate during another embodiment of manufacturing an interconnection structure.
Figure 4A:
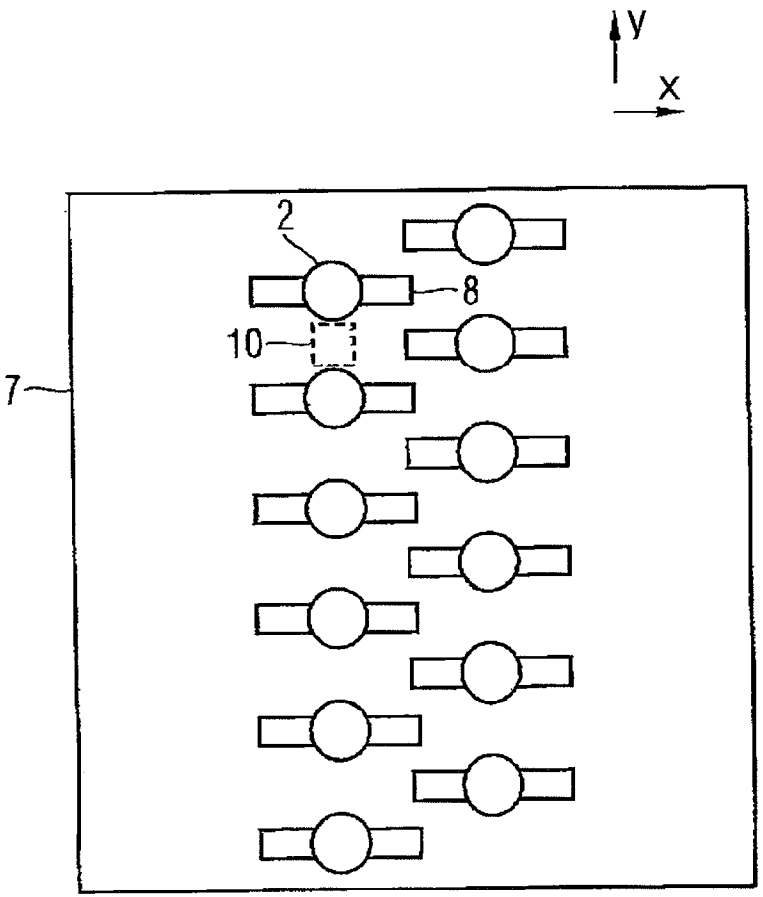

Referring to FIGS. 4A and 4B, line arrays according to further embodiments of the invention are shown. The line array of FIG. 4A merely comprises intermediate contact lines 8 extending along the second direction x, wherein each of the intermediate contact lines is absent in the respective intersection region 10.

Referring to FIG. 4B, each line of the line array again comprises an intermediate contact line 8 and a further contact line 9 being interrupted within the respective intersection region 10. As is also the case in the layout of FIG. 4A, the distance between the two contact rows in FIG. 4B is chosen larger than in the layout of FIG. 2A. As is obvious to the person skilled in the art, many layouts may be appropriately chosen with regard to feasibility of lithography taking into account the interruption of each line within the intersection region 10.

Next, FIGS. 5A to 8C will provide more details with regard to further embodiments in view of the formation of the intermediate contact lines 8 and the conductive lines 12.

Figure 5B:
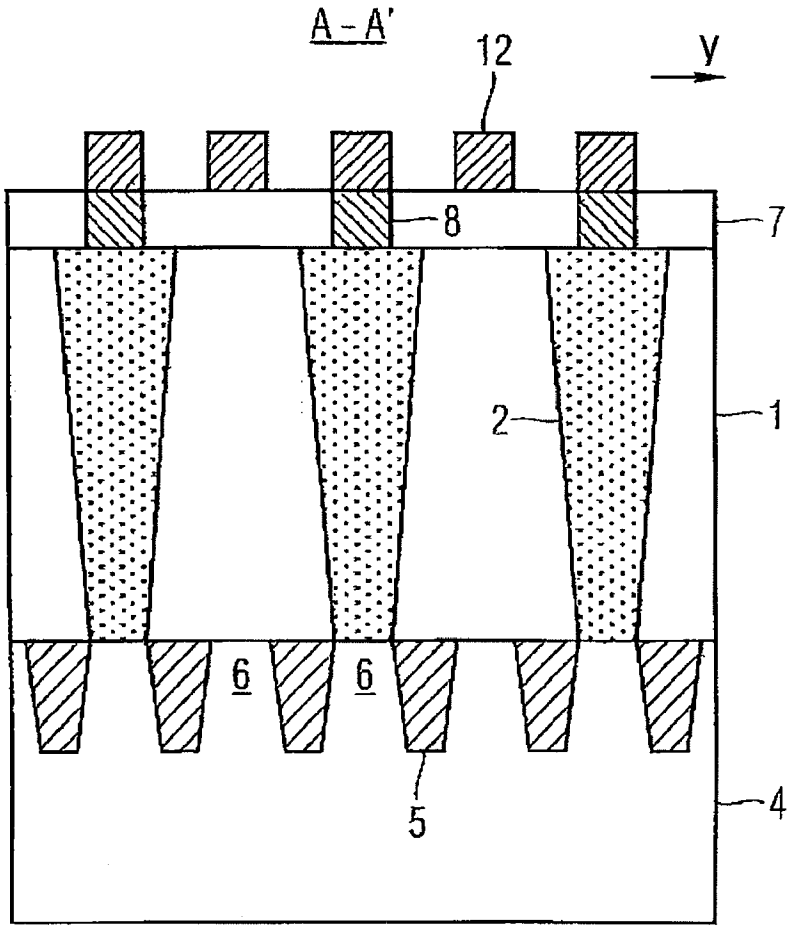
FIGS. 5A to 8C show cross-sectional views of the section of a substrate during further embodiments of manufacturing an interconnection structure.
Figure 5A:
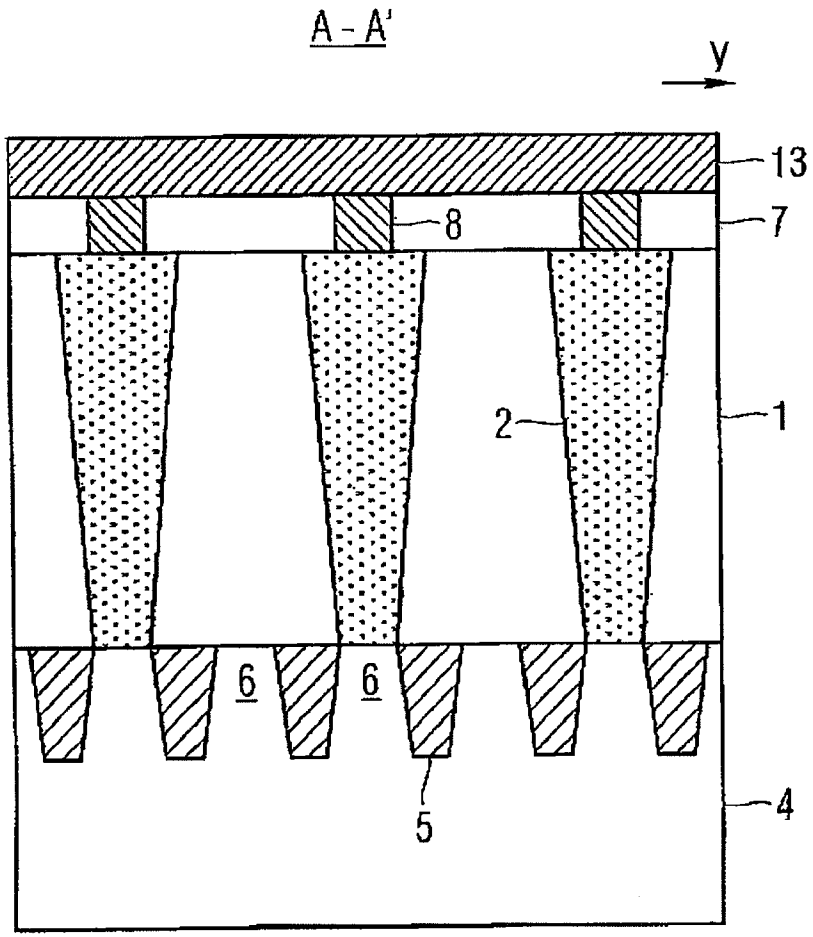

Referring to FIG. 5A, the intermediate contact lines 8 are formed within the second insulating layer 7 as already described with regard to the cross-sectional view of FIG. 2B. Subsequently, a conductive material 13 is applied on the top surface of the second insulating layer 7 and the intermediate contact lines 8.

With regard to the cross-sectional view of FIG. 5B, the conductive material 13 is etched to provide the conductive lines 12. After etching the conductive material 13 the third insulating layer 11 may be provided between the conductive lines 12, thereby arriving at the structure of FIG. 3B.

Figure 6B:
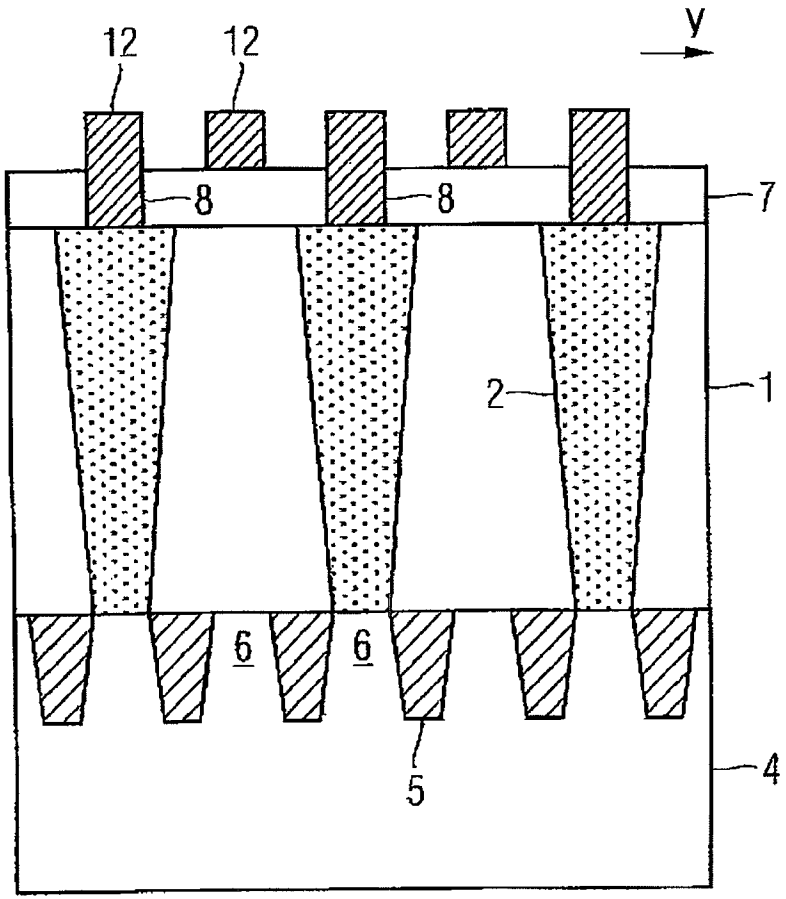
Figure 6A:
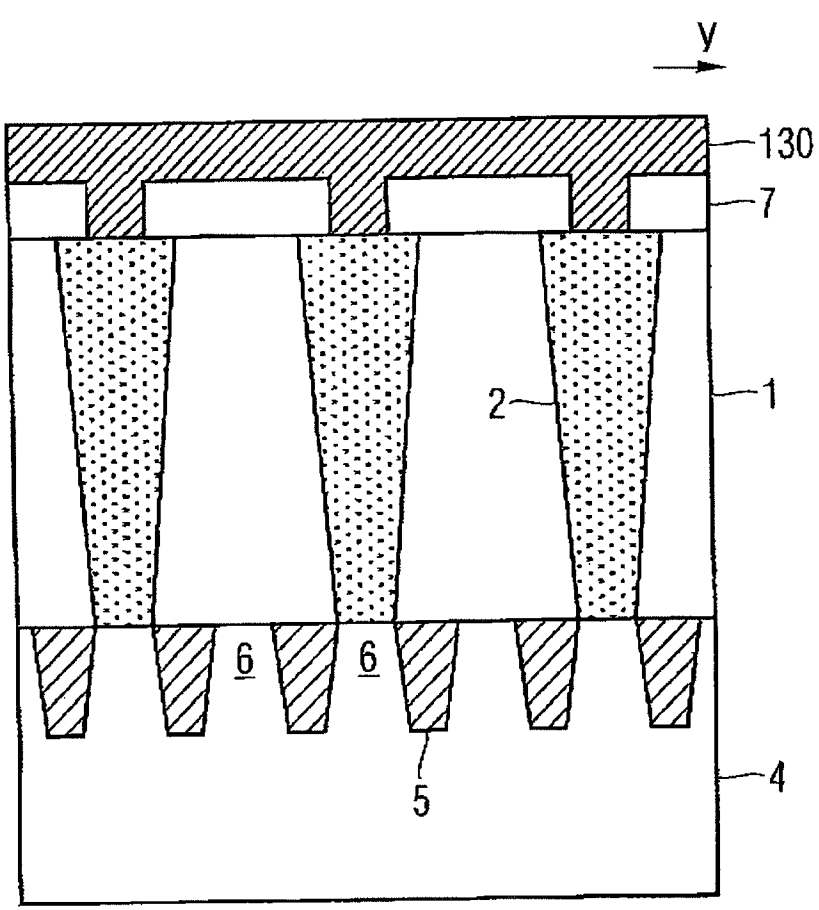
Figure 6C:
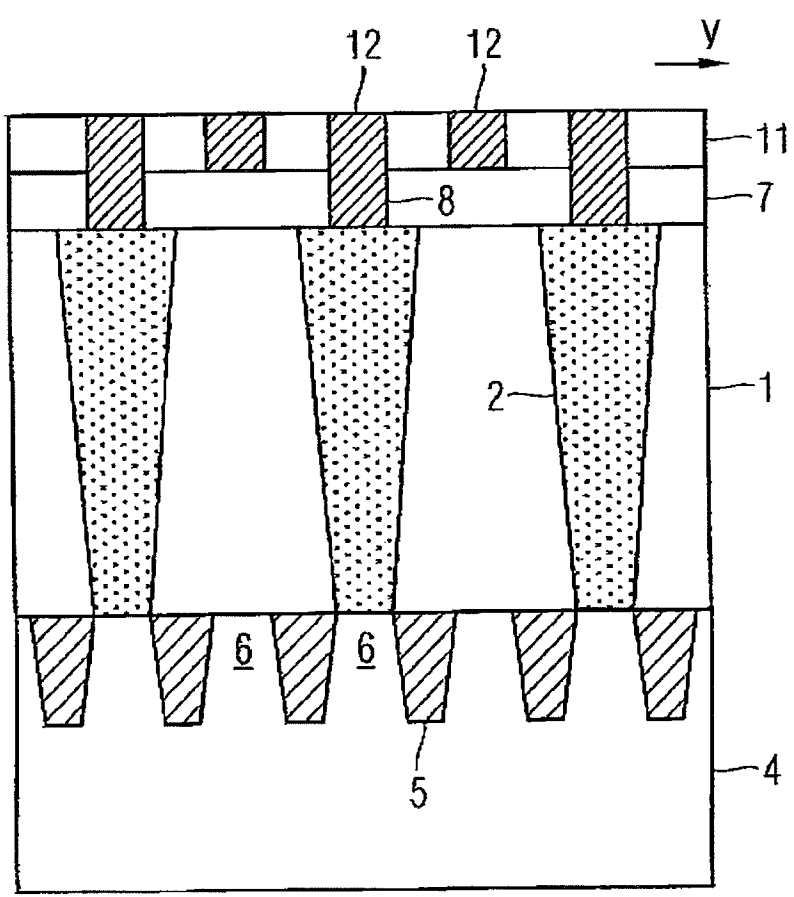

Referring to FIGS. 6A-6C, a further embodiment addressing the formation of the intermediate contact lines 8 and conductive lines 13 will be described in more detail. Starting from a process stadium, in which the second insulating layer 7 is etched to provide intermediate contact line openings, the conductive material 130 is filled into the intermediate contact line openings and also covers the surface of the second insulating layer 7.

Turning now to the cross-sectional view of FIG. 6B, the conductive material 130 is etched to provide the conductive lines 12.

Referring to FIG. 6C, the third insulating layer 11 is provided between neighboring conductive lines 12. Thus the conductive material 130 is common to the intermediate contact lines 8 and the conductive lines 12.

Figure 7:
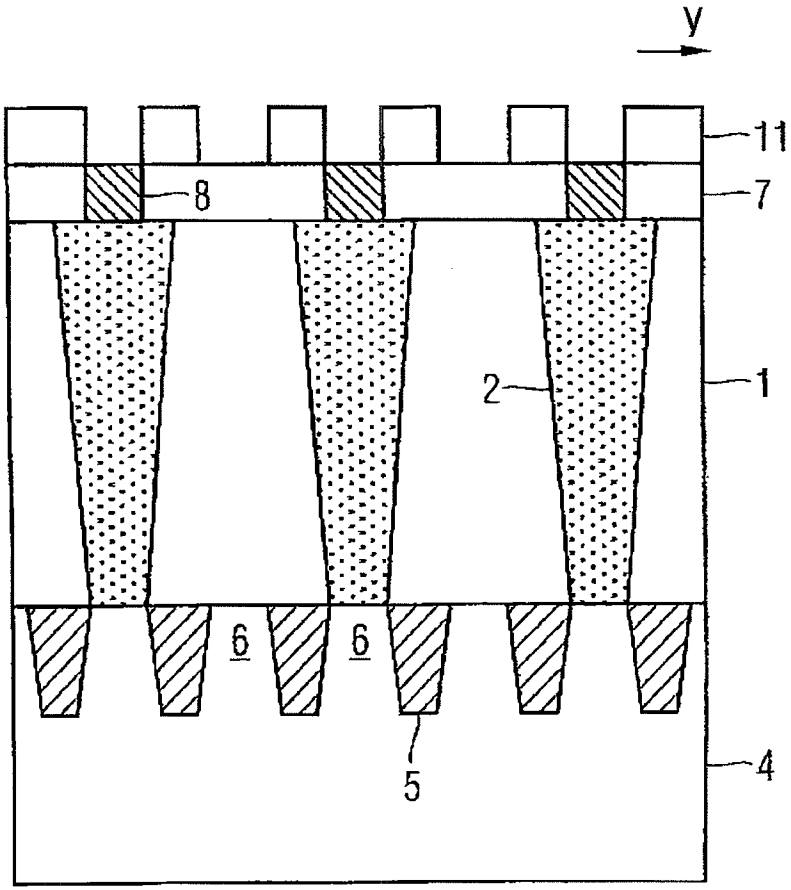

Referring to FIG. 7, a further embodiment related to the formation of the conductive lines 12 will be described in more detail. After providing the intermediate contact lines 8 within the second insulating layer 7 as described with regard to the cross-sectional view of FIG. 2B, the third insulating layer 11 is applied on the second insulating layer 7 and the intermediate contact lines 8. Next, the third insulating layer 11 is etched to provide conductive line openings therein. Thereafter, the conductive line openings are filled with a conductive material to arrive at the layout shown in the cross-sectional view of FIG. 3B. When filling the conductive line openings with the conductive material, the conductive material may also be applied on the third insulating layer 11, followed by chemical mechanical polishing to remove remaining conductive material from the surface of the third insulating layer 11. The conductive lines 12 are thus provided by a damascene process.

Figure 8B:
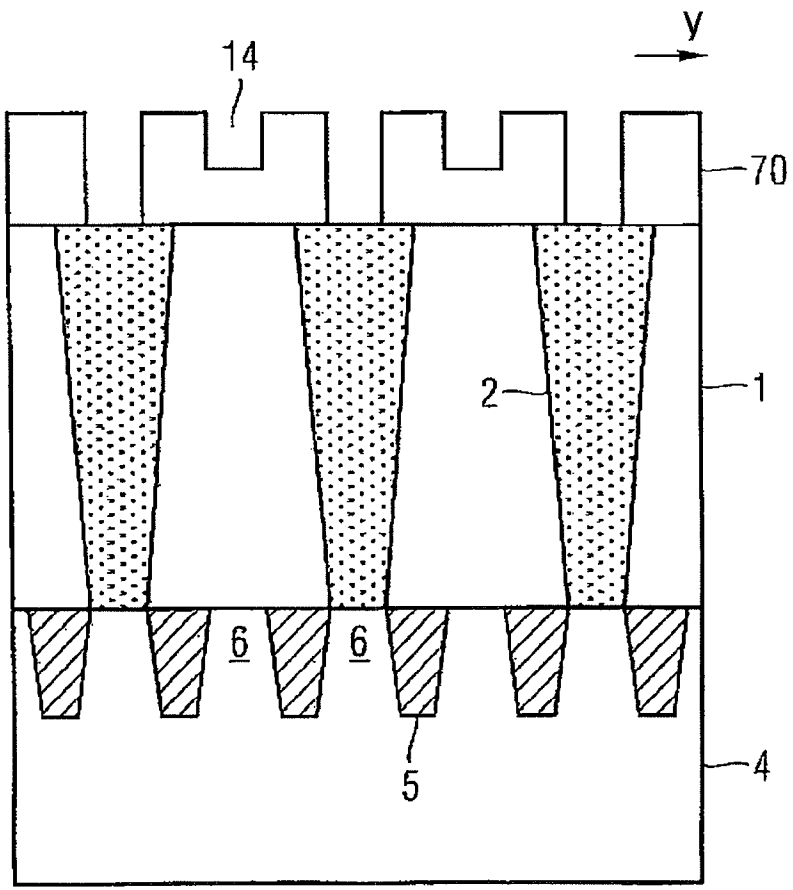
Figure 8A:
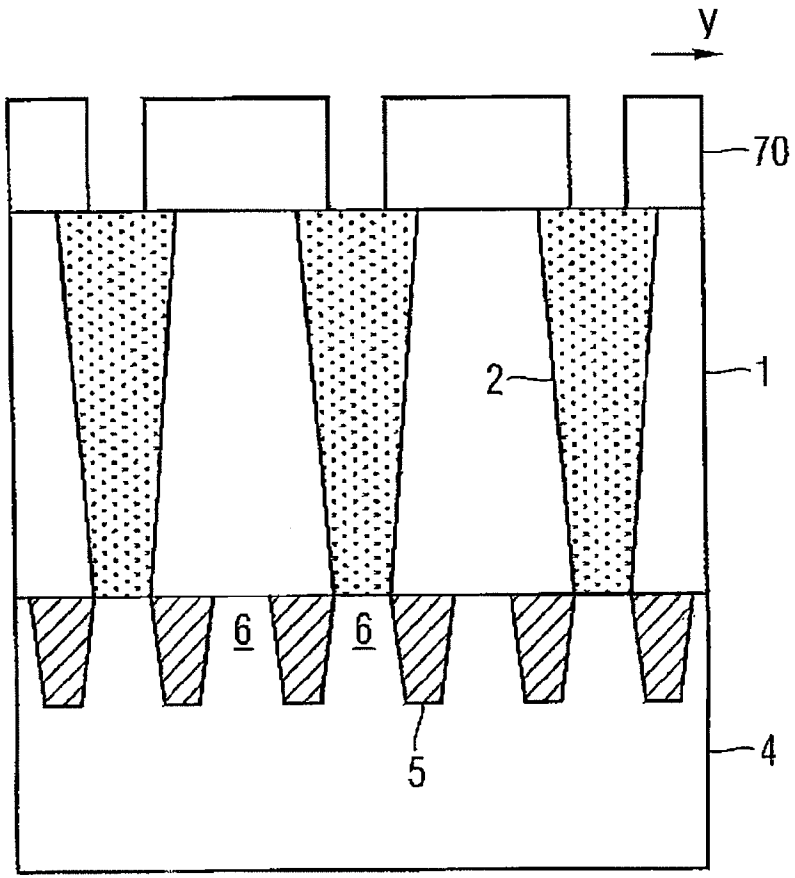
Figure 9A:
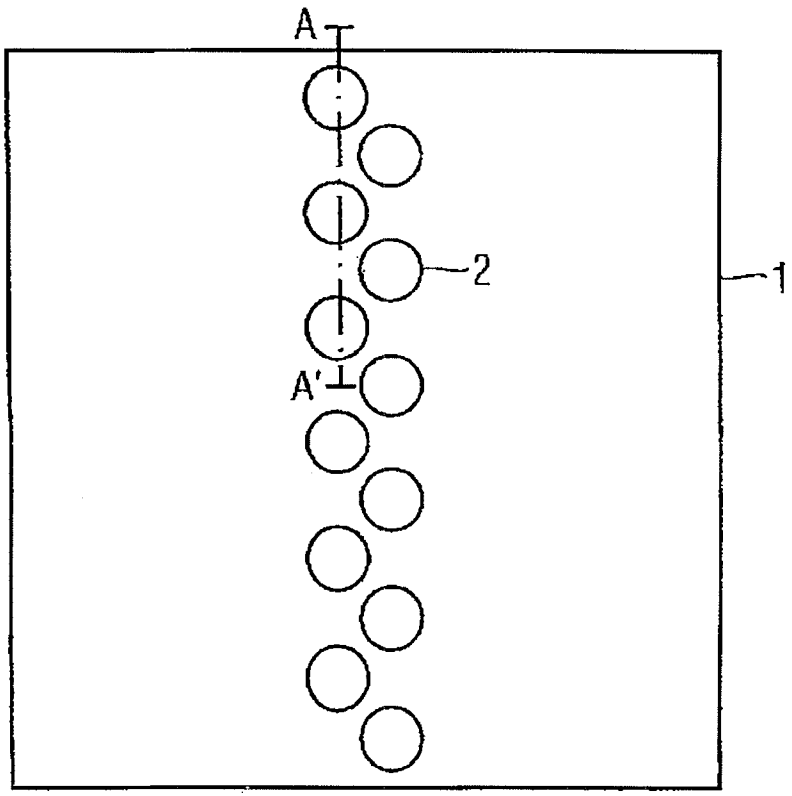
FIGS. 9A to 11 show plan views and cross-sectional views of the section of a substrate during another embodiment of manufacturing an interconnection structure.
Figure 8C:
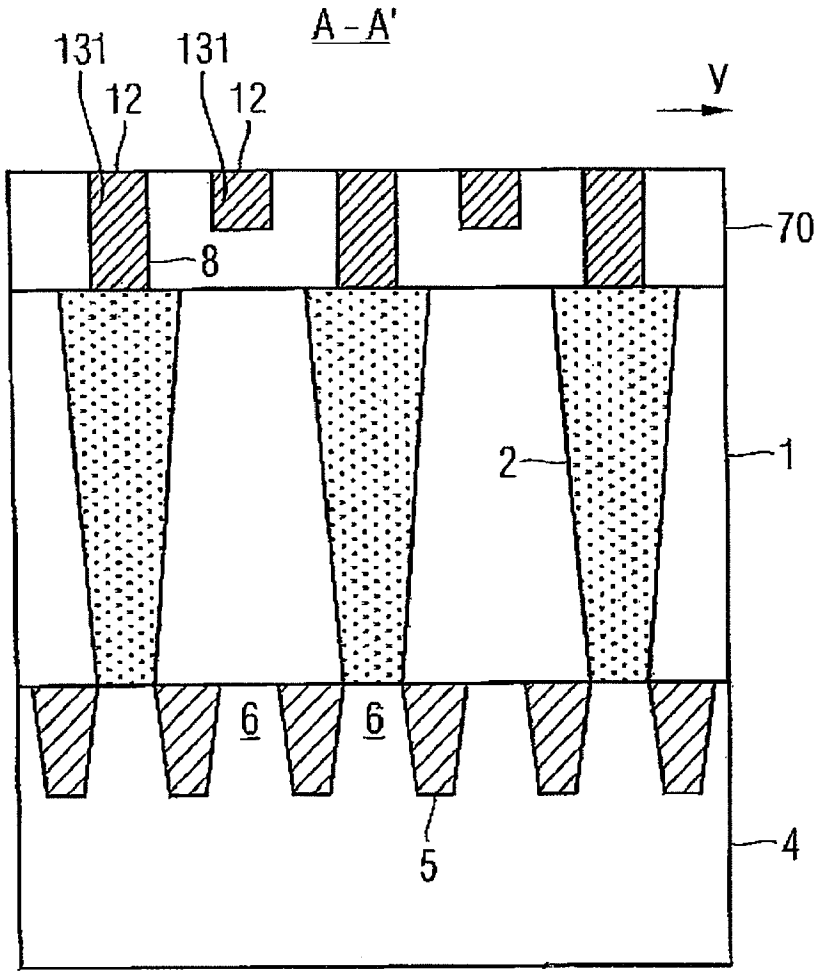

Turning now to FIGS. 8A to 8C, a further embodiment related to the formation of the intermediate contact lines 8 and the conductive lines 12 is elucidated in more detail. After formation of the contacts 2 within the first insulating layer 1, the second insulating layer 70 is applied on the surface of the first insulating layer 1 and the contacts 2. The second insulating layer 70 of the present embodiment is thicker than the insulating layer 7 of FIG. 7. It may comprise a thickness equal to the vertical extension of the intermediate contact lines 8 and the conductive lines 12 to be formed in later process steps. First, the second insulating layer 70 is etched to provide intermediate contact line openings.

Thereafter, as is illustrated in the cross-sectional view of FIG. 8B, a further etching is carried out in the second insulating layer 70 to provide conductive line trenches 14 therein.

Referring to FIG. 8C, the conductive line trenches and the intermediate contact line openings are filled with the conductive material 131 to provide the intermediate contact lines 8 and the conductive lines 12. Thus a dual damascene process is carried out. It is to be noted that an upper part of the intermediate contact line openings being on a common level with the conductive line trenches 14 will later be used as part of the conductive lines 12.

Referring to FIGS. 9A to 11 a further embodiment of forming an interconnection structure will be described. Starting with the plan view of FIG. 9A, two staggered rows of contacts 2 are provided within the first insulating layer 1.

Figure 9B:
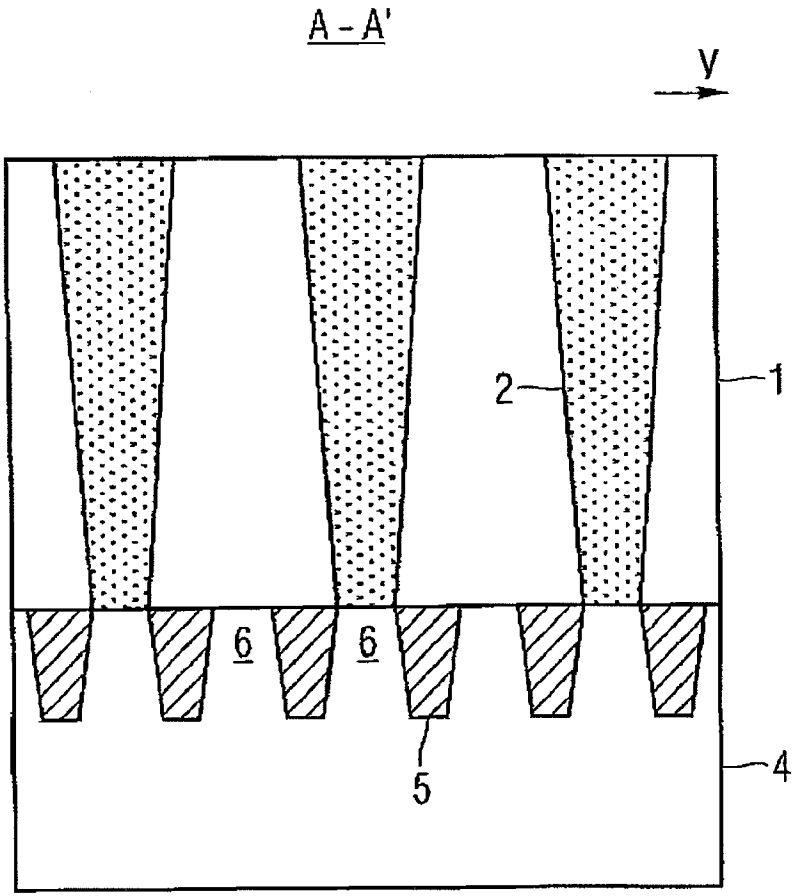

A cross-sectional view along the intersection line A-A' is shown in FIG. 9B. Again, the substrate 4 comprises active areas 6 formed in a surface region thereof, wherein the active areas 6 are isolated from each other by STI regions 5. As already pointed out above, any pre-processed substrate 4 comprising surface parts to be connected to the interconnection structure may be used.

Figure 10:
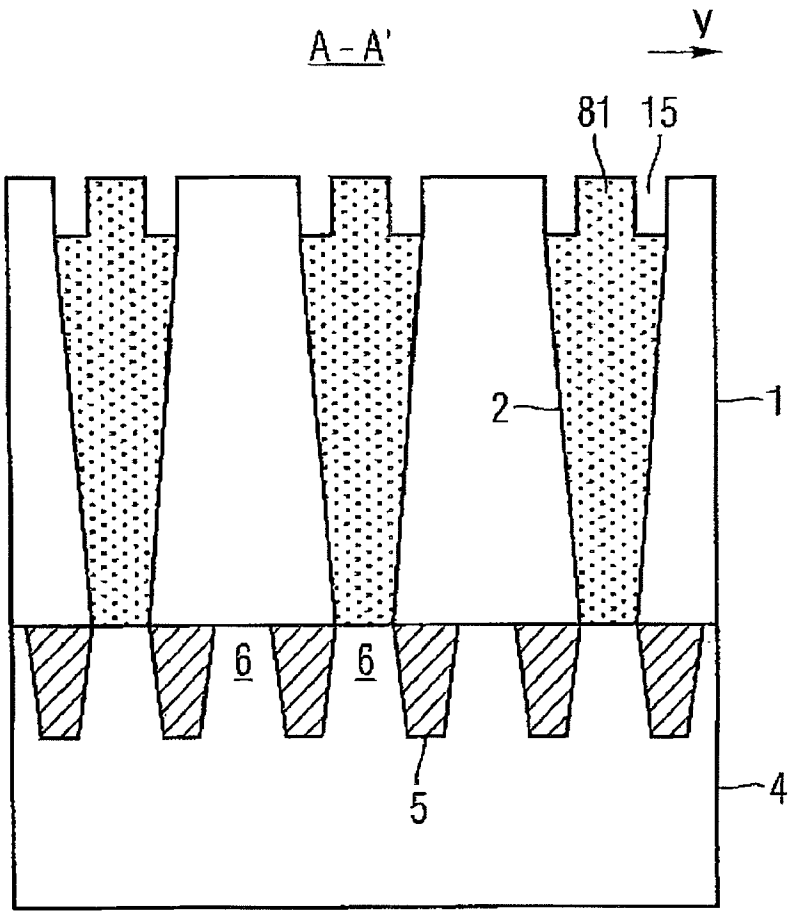

Next, referring to FIG. 10, the contacts 2 are trimmed along the first direction y in an upper contact region thereof to define the intermediate contacts 81, wherein a lower contact region remains unaltered. Trimming of the contacts 2 may be carried out by providing an appropriate mask structure on the first insulating layer 1 and the contacts 2, wherein the mask structure partly covers the contacts 2 (not shown). After trimming of the contacts 2, voids 15 remain in the first insulating layer 1.

Figure 11:
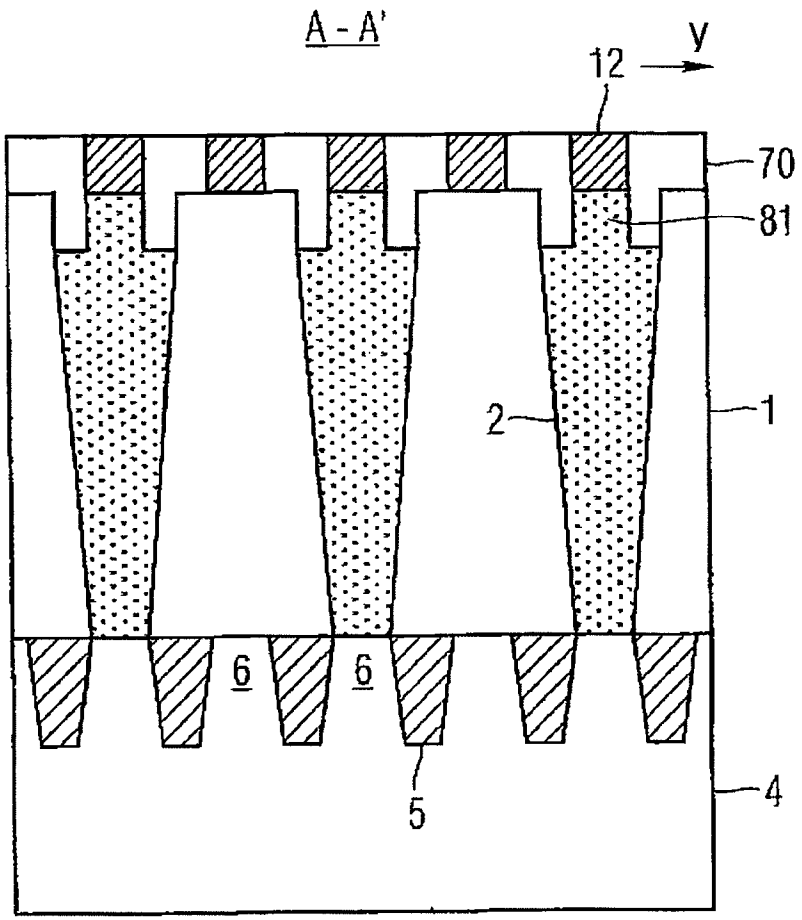

Referring to FIG. 11, conductive lines 12 are provided on the intermediate contacts 81 and the insulating layer 1, wherein neighboring conductive lines 12 are isolated from each other by the second insulating layer 70. The second insulating layer also fills the voids 15.

Figure 12:
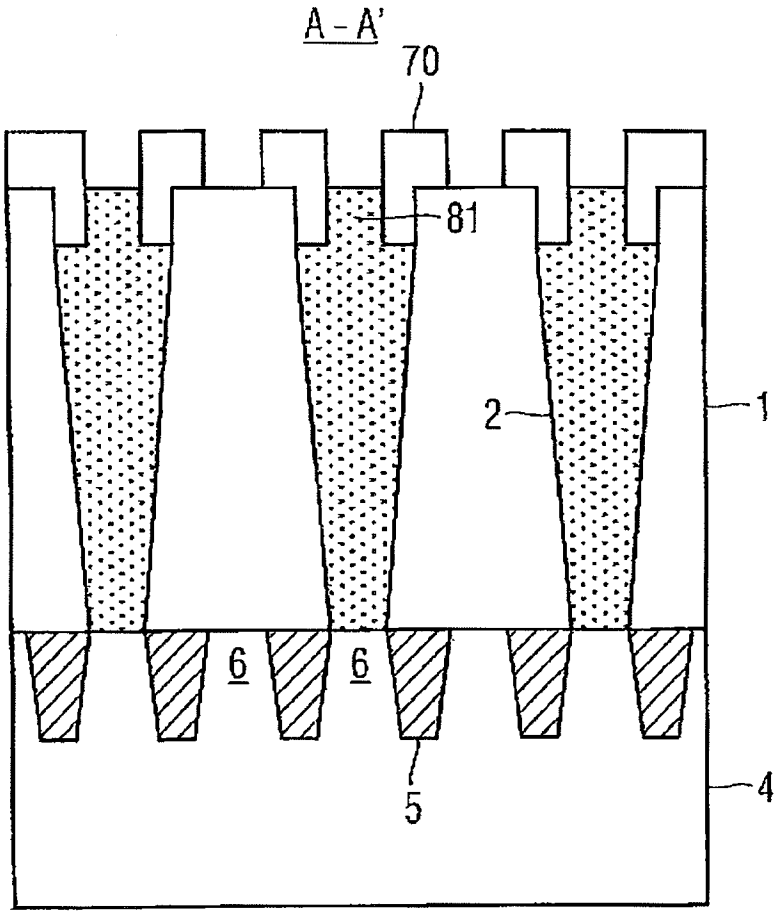
FIGS. 12 to 13B show cross-sectional views of the section of a substrate during manufacture of an interconnection structure according to further embodiments.
Figure 13B:
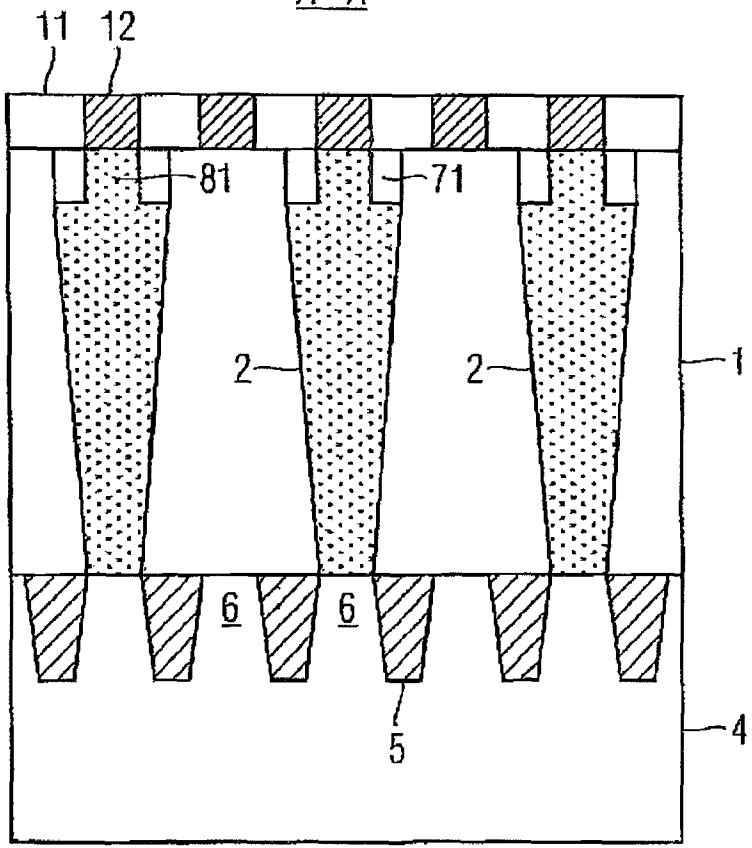

FIGS. 12 to 13B show further embodiments related to the formation of the conductive lines 12.

Referring to FIG. 12, the second insulating layer 70 is formed within the voids 15 and also applied onto the surface of the first insulating layer 1. Next, conductive line openings are etched into the second insulating layer 70, followed by filling the conductive line openings with the conductive material to provide the conductive lines 12. A cross-sectional view of the resulting structure is shown in FIG. 11. In this embodiment the conductive lines are formed by a damascene process.

Figure 13A:
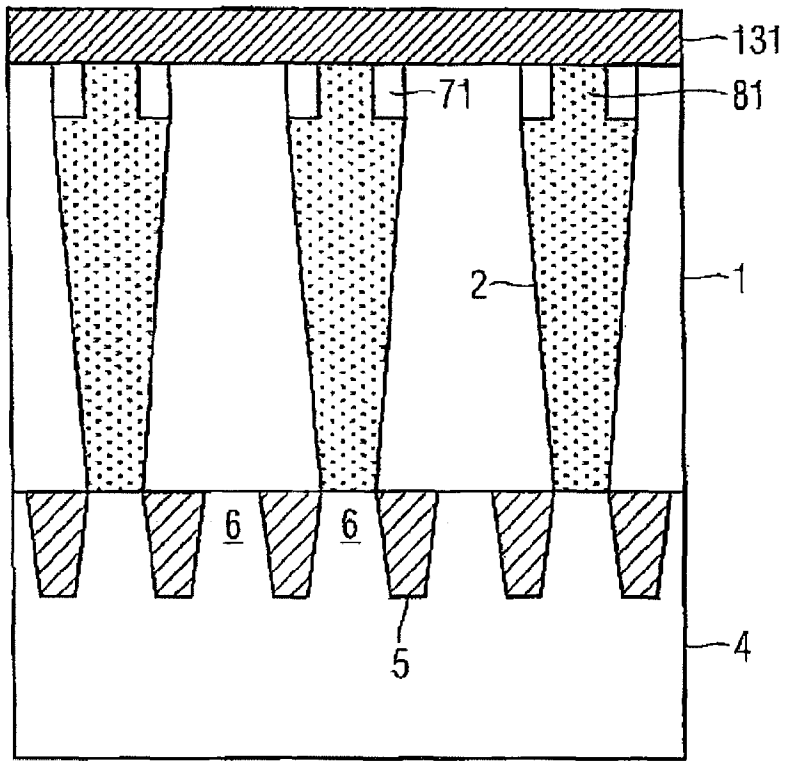

Referring to the cross-sectional views of FIGS. 13A and 13B, a further embodiment is elucidated in more detail. After trimming the contacts 2, as is shown in FIG. 13A, the second insulating layer 71 is filled into the voids 15. Filling the voids 15 may be accomplished by first depositing an insulating material into the voids 15 as well as onto the first insulator 1, followed by a chemical mechanical polishing to remove the insulating material from the surface of the first insulating layer 1, thereby leaving the second insulating layer 71 in the voids 15. Thereafter, the conductive material 131 is applied onto the first insulating layer 1, the second insulating layer 71 and the intermediate contacts 81.

Referring to FIG. 13B, the conductive material 131 is etched to provide the conductive lines 12, followed by applying the third insulating layer 11 in between neighboring conductive lines 12. The method steps of forming the conductive lines 12 are similar to the embodiment shown in FIGS. 5A and 5B.

Figure 14:
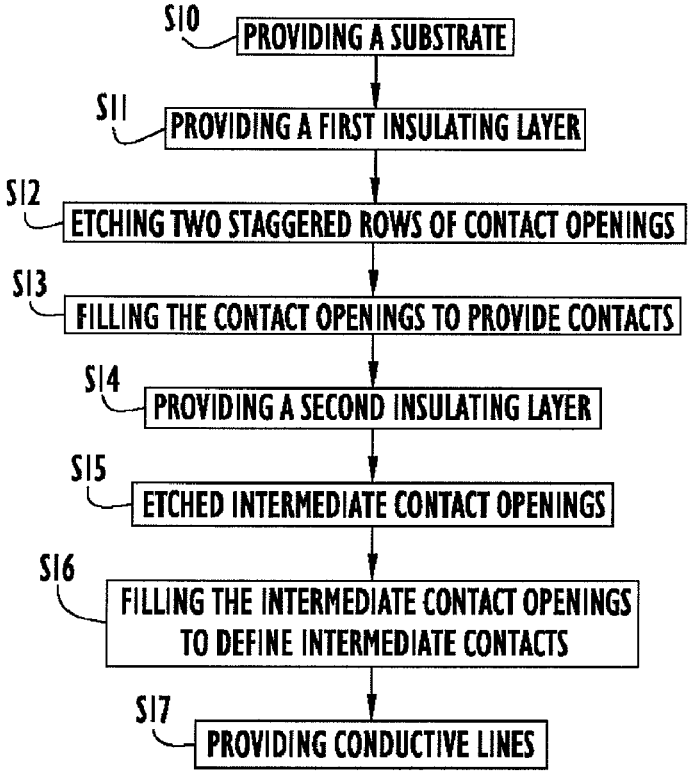
FIG. 14 shows a flowchart illustrating an embodiment of a method for manufacturing an interconnection structure.

In the following, embodiments of a method of forming an interconnection structure will be briefly explained with reference to flowcharts illustrated in FIGS. 14 and 15. As is shown in FIG. 14, for manufacturing the interconnection structure, first, a substrate is provided (S10). For example, the substrate may be a layered substrate comprising a semiconductor substrate and one or more layers which are deposited on the surface of the semiconductor substrate. Subsequently, a first insulating layer is provided on the substrate (S11). For example, the first insulating layer may comprise a dielectric material such as silicon oxide of silicon nitride. Thereafter, an etching step is performed so as to define two staggered rows of evenly spaced contact openings, wherein each row extends along a first direction (S12). For example, this etching step may be a tapered etching step. Thereafter, the contact openings are filled with a conductive material to provide contacts (S13). Thereafter, a second insulating layer is provided on the first insulating layer and the contacts (S14). The second insulating layer may be of a material which is different from the material of the first insulating layer or it may be made of the same material. Then, intermediate contact openings are etched into the second insulating layer (S15). Thereafter, intermediate contacts are defined by filling the intermediate contact openings with the conductive material (S16). Thereafter, conductive lines are provided on the second insulating layer and the intermediate contacts, wherein the conductive line extends along a second direction intersection the first direction (S17).

Figure 15:
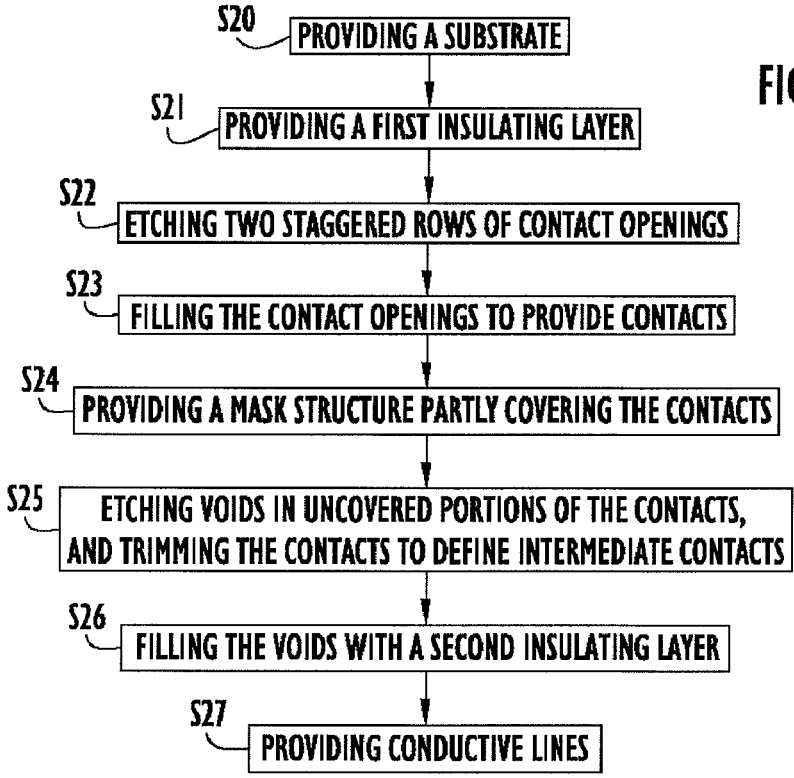
FIG. 15 shows a flowchart illustrating a further embodiment of a method of manufacturing an interconnection structure.

Turning now to FIG. 15, a further embodiment of a method of forming an interconnection structure will be briefly explained. Examples of materials regarding elements of the flowchart in FIG. 14, e.g., materials for the substrate or the insulating layers, also hold true for corresponding or similar elements cited herein below. As is shown in FIG. 15, first, a substrate is provided (S20). Subsequently, a first insulating layer is provided on the substrate (S21). Thereafter, two staggered rows of evenly spaced contact openings are etched into the first insulating layer, wherein each row extends along a first direction (S22). Thereafter, the contact openings are filled with a conductive material to provide contacts (S23). Subsequently, a mask structure is provided on the first insulating layer and the contacts, wherein the mask structure partly covers the contacts (S24). Thereafter, uncovered portions of the contacts are etched, thereby generating voids and trimming the contacts along the first direction in upper contact regions defining intermediate contacts, wherein a lower contact region remains unaltered (S25). Thereafter, the voids are filled with a second insulating layer (S26). Subsequently, conductive lines are provided on the first insulating layer and the intermediate contacts, wherein the conductive lines extend along a second direction intersecting the first direction (S27).

While the invention has been described in detail with reference to specific embodiments thereof, it will be apparent to one of ordinary skill in the art that various changes and modifications can be made therein without departing from the spirit and scope thereof. Accordingly, it is intended that the present invention covers the modifications and variations of this invention provided they come within the scope of the appended claims and their equivalents.

What is claimed is:

1. An interconnection structure comprising:

a first contact row of spaced contacts extending along a first direction;

a second contact row of spaced contacts extending along the first direction, the contacts of the second contact row being staggered along the first direction in relation to the contacts of the first contact row;

a plurality of conductive lines extending along a second direction intersecting the first direction;

a plurality of intermediate contacts, each intermediate contact being in contact with a respective one of the contacts and a respective one of the conductive lines; and an insulating layer adjoining a bottom side of the conductive lines and a sidewall of the intermediate contact lines.

2. The interconnection structure of claim 1, wherein the contacts of the first and second contact rows are shifted by one half contact pitch relative to each other.

3. The interconnection structure of claim 1, wherein a dimension of the intermediate contacts along the first direction is smaller than a largest dimension of the contacts along the first direction.

4. The interconnection structure of claim 1, wherein each intermediate contact is a trimmed part of the respective contact shortened along the first direction.

5. The interconnection structure of claim 1, wherein the intermediate contacts are intermediate contact lines extending in a linear array along the second direction.

6. The interconnection structure of claim 5, wherein each intermediate contact line in contact with a respective contact of one of the first and second contact rows is absent at an intersection region in relation to the other one of the first and second contact rows.

7. The interconnection structure of claim 6, wherein the line array comprises:

intermediate contact lines; and further lines.

8. The interconnection structure of claim 1, wherein a contact pitch of each contact row is two times a minimum feature size.

9. The interconnection structure of claim 1, wherein a contact pitch of each contact row is four times a minimum feature size.

10. An electric device comprising:

an electric card interface;

a card slot connected to the electric card interface; and an electric memory card comprising the interconnection structure of claim 9;

wherein the electric memory card is configured to be connected to and removed from the card slot.

11. The interconnection structure of claim 1, wherein the intermediate contact lines are comprised in a line array.

12. The interconnection structure of claim 1, wherein a dimension of the intermediate contact lines along the first direction is smaller than the largest dimension of the contacts along the first direction.

13. A non-volatile semiconductor memory device comprising:

a memory cell array of non-volatile memory cells; and an interconnection structure comprising:

a first contact row of spaced contacts extending along a first direction;

a second contact row of spaced contacts extending along the first direction, the contacts of the second contact row being staggered along the first direction in relation to the contacts of the first contact row;

a plurality of conductive lines extending along a second direction intersecting the first direction; and a plurality of intermediate contacts, each intermediate contact being in contact with a respective one of the contacts and a respective one of the conductive lines;

wherein the conductive lines comprise bit lines and the contacts and respective intermediate contacts comprise bit line contacts.

14. An electric memory card comprising the non-volatile semi-conductor memory device of claim 13.

15. An interconnection structure comprising:

a first contact row of spaced contacts extending along a first direction;

a second contact row of spaced contacts extending along the first direction, the contacts of the second contact row being staggered along the first direction in relation to the contacts of the first contact row;

a plurality of conductive lines extending along a second direction intersecting the first direction; and a plurality of intermediate contacts, each intermediate contact being in contact with a respective one of the contacts and a respective one of the conductive lines;

wherein each intermediate contact line, in contact with a respective contact of one of the two staggered contact rows, is absent in an intersection region with regard to the other one of the two staggered contact rows.

16. An interconnection structure comprising:

a first contact row of spaced contacts extending along a first direction;

a second contact row of spaced contacts extending along the first direction, the contacts of the second contact row being staggered along the first direction in relation to the contacts of the first contact row;

a plurality of conductive lines extending along a second direction intersecting the first direction;

a plurality of intermediate contacts, each intermediate contact comprising a trimmed upper part of a respective contact that adjoins a respective one of the conductive lines; and an insulating layer adjoining a bottom side of the conductive lines and a sidewall of the intermediate contact lines.

* * * * *